US005652948A

United States Patent [19]

Sakaguchi et al.

[11] Patent Number: 5,652,948

[45] Date of Patent: Jul. 29, 1997

[54] IMAGE FORMING APPARATUS

[75] Inventors: Genta Sakaguchi, Toyohashi; Toshihiko Kumon, Aichi-Ken; Hitoshi Sekino, Toyokawa; Kazuyoshi Hara, Toyohashi; Tatsuya Isono, Toyokawa, all of Japan

[73] Assignee: Minolta Co., Ltd., Osaka, Japan

[21] Appl. No.: 609,725

[22] Filed: Mar. 1, 1996

Related U.S. Application Data

[63] Continuation of Ser. No. 548,326, Nov. 1, 1995, abandoned.

[30] Foreign Application Priority Data

Nov. 4, 1994 [JP] Japan ..... 6-270969
Jun. 16, 1995 [JP] Japan ..... 7-150635

[51] Int. Cl.[6] ..... G03G 15/14

[52] U.S. Cl. ..... 399/66; 399/71; 399/297; 399/302

[58] Field of Search ..... 355/275, 272, 355/273, 271, 326 R, 327; 399/66, 71, 297, 302

[56] References Cited

U.S. PATENT DOCUMENTS 4,931,839 6/1990 Tompkins et al. ..... 355/277
5,138,363 8/1992 Yuge ..... 355/326 R
5,237,374 8/1993 Ueno et al. ..... 355/299

FOREIGN PATENT DOCUMENTS 3-37693 2/1991 Japan .

*Primary Examiner*—Nestor R. Ramirez
*Attorney, Agent, or Firm*—Sidley & Austin

[57] ABSTRACT

In an image forming apparatus, a toner image, formed by developing an electrostatic latent image on the photoreceptor, is primarily transferred to an intermediate transfer member and is secondarily transferred to a recording sheet. The image forming apparatus is provided with a retractable transfer member, which secondarily transfers the toner image on the recording sheet, and a retractable cleaning member, which removes a residual toner on the intermediate transfer member after the secondary transfer. In the above apparatus, when the primary transfer and the secondary transfer are not being performed, the transfer member and the cleaning member are allowed to contact with or retract from the intermediate transfer member.

18 Claims, 12 Drawing Sheets

IMAGE FORMING APPARATUS

This application is a continuation application of U.S. Ser. No. 08/548,326, filed Nov. 1, 1995, now abandoned.

BACKGROUND OF THE INVENTION

1. Field of the Invention

This invention relates to an image forming apparatus, and more particularly to an apparatus that forms a full-color image on a recording sheet utilizing an electrophotographic technique.

2. Description of the Related Arts

Conventionally, as disclosed in U.S. Pat. No. 4,931,839, an image forming apparatus is proposed that sequentially develops electrostatic images formed on a photoreceptor with yellow toner, magenta toner, cyan toner and black toner to sequentially transfer each of the toner images onto a transfer belt in a transfer station (primary transfer) for forming a composite image. In said image forming apparatus, the composite image on the transfer belt is further transferred to a sheet in a composite image transfer station (secondary transfer).

In said image forming apparatus, a secondary transfer roller, that can be brought into contact with and retracted from the transfer belt, is provided in the composite image transfer station. While a composite image is being formed on the transfer belt, the secondary transfer roller is retracted from the transfer belt. Then, after the composite image is formed on the transfer belt, the secondary transfer roller is brought into contact with the transfer belt through a sheet so that the composite image is transferred onto the sheet.

Furthermore, Japanese Laid-open Patent Application Hei 3-37693 discloses a full-color image forming apparatus provided with a cleaning blade that can be brought into contact with and retracted from the transfer belt. In this apparatus the cleaning blade is retracted from the transfer belt during the primary transfer for forming the composite image, and is brought into contact with the transfer belt when the leading end of the composite image passes the position wherein the secondary transfer is performed, thereby the toner remaining on the transfer belt is removed.

However, when the secondary transfer roller or the cleaning blade is retracted from the transfer belt during the first primary transfer for the next print, problems such as vibrations occurs on the transfer belt, resulting in that uneven primary transfer images for the next print occurs. Moreover, when the cleaning blade is brought into contact with the transfer belt during secondary transfer to the copying paper, a problem of uneven secondary transfer images occurs.

Even further, when the secondary transfer roller and the cleaning blade are brought into contact with or retracted from the transfer belt, if both the secondary transfer roller and cleaner are brought into contact with or retracted from the transfer belt at the same time, vibration occurring on the transfer belt becomes stronger and, as a result, there was a possibility of bad influence spreading to toner images on the transfer belt.

On the other hand, if the secondary transfer roller is brought into contact with the transfer belt for more time than necessary, there is a possibility that toner remaining on the transfer belt is adhered to the secondary transfer roller and the toner adhered to the secondary transfer roller is transferred to the rear side of the copying paper. Moreover, if the time the cleaning blade makes contact with the transfer belt is short, there is a possibility that toner may remained on the transfer belt after the cleaning by the cleaning blade. Therefore, it was very difficult to maintain the contact and retraction operation of the secondary transfer roller and the cleaning blade while eliminating these problems.

Furthermore, another problem also occurs in which an electrical discharge and electromagnetic noise are generated when the secondary transfer roller is brought into contact with or retracted from the transfer belt while being applied with a voltage for the secondary transfer.

SUMMARY OF THE INVENTION

The main object of the present invention is to provide an image forming apparatus that can form correct full-color images.

Another object of the present invention is to provide a compact full-color image forming apparatus.

These and other objects of the present invention are achieved by providing an image forming apparatus wherein a toner image, formed by developing an electrostatic latent image on the photoreceptor, is primarily transferred to an intermediate transfer member and is secondarily transferred to a recording sheet, said image forming apparatus comprising:

a retractable transfer member which secondarily transfers the toner image onto the recording sheet;

a retractable cleaning member which removes a residual toner on the intermediate transfer member after the secondary transfer;

a first detector which detects whether the primary transfer is being performed;

a second detector which detects whether the secondary transfer is being performed; and a controller which allows the transfer member and the cleaning member to contact with or retract from the intermediate transfer member when the primary transfer and the secondary transfer are not being performed.

These and other objects, advantages and features of the present invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Referring to the accompanying drawings the embodiments of this invention will be described.

Figure 1:
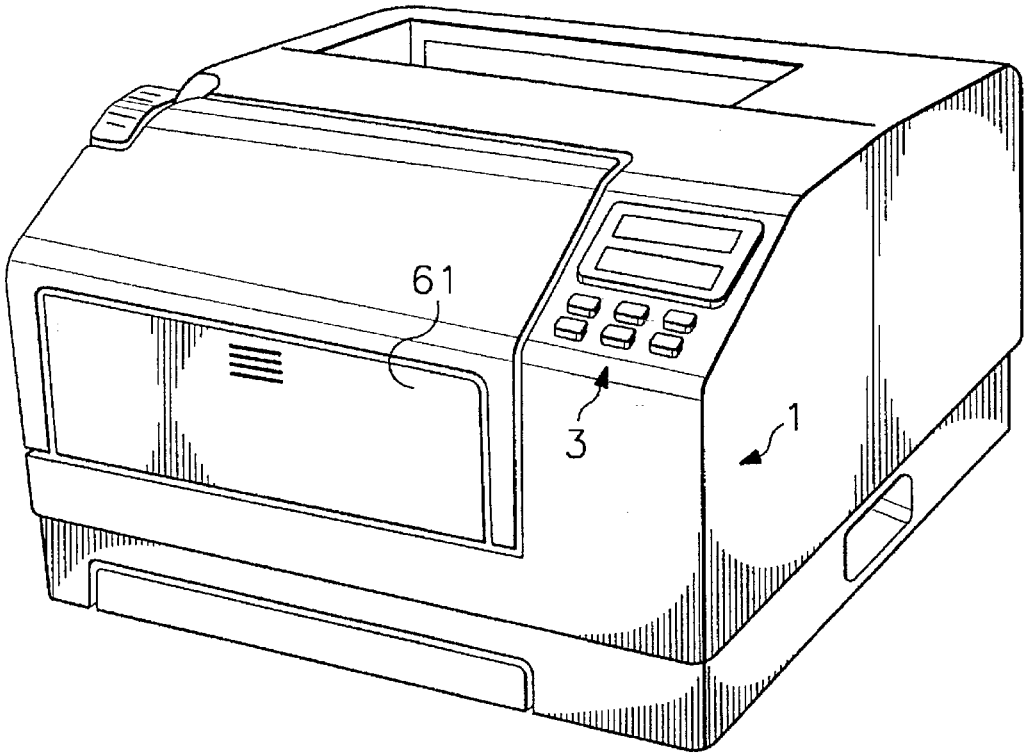
FIG. 1 is the external appearance of a full-color laser printer as the first embodiment according to the present invention.
Figure 2:
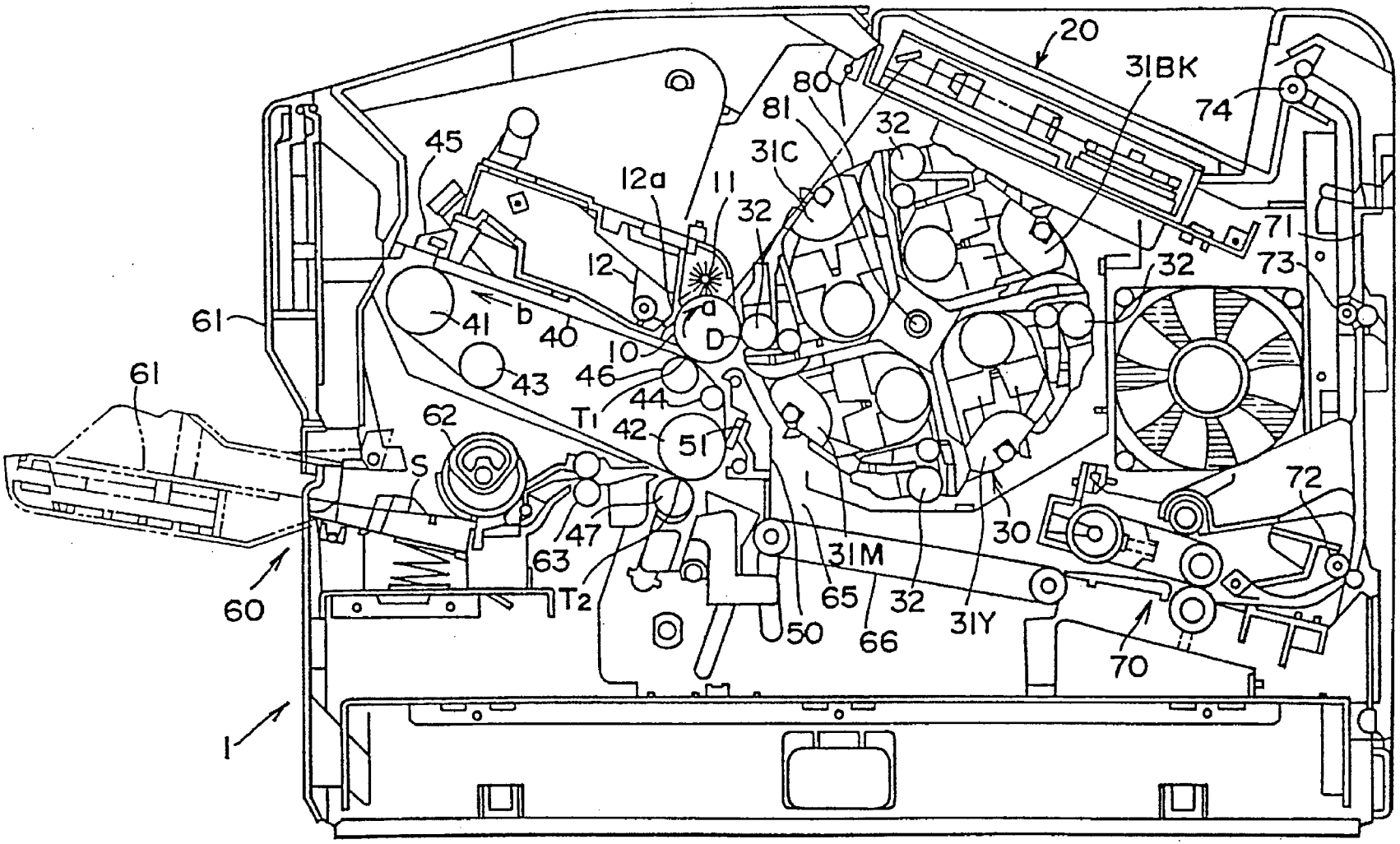
FIG. 2 shows the internal mechanism of the printer shown in FIG. 1.

FIG. 1 is the external appearance of a full-color laser printer as the first embodiment of the present invention and FIG. 2 shows the internal mechanism of the printer shown in FIG. 1.

In FIG. 2, a printer 1 comprises a photoreceptor drum 10, driven to rotate in a direction as shown by an arrow a, a laser scanning optical system 20, a full-color developing apparatus 30, a flexible endless intermediate transfer belt 40, driven to rotate in a direction as shown by an arrow b and a paper feeder 60. On the periphery of the photoreceptor drum 10, a charging brush 11 and a cleaner 12 are further provided. The charging brush 11 uniformly charges the surface of the photoreceptor drum 10 to a predetermined electric potential. The cleaner 12 scrapes off toner remaining on the photoreceptor drum 10 using a blade 12*a*.

The laser scanning optical system 20 is a well-known system incorporating a laser diode, a polygon mirror and a f optical element. Each printing data of C (cyan), M (magenta), Y (yellow) and Bk (black) is transmitted from the host computer to the CPU 100 (see FIG. 7). The laser scanning optical system 20 irradiates a laser beam based on each printing data received by the CPU to expose the surface of the photoreceptor drum 10, thereby an electrostatic latent image corresponding to each color is formed on the photoreceptor drum 10.

The full-color developing unit 30 is composed of a developing rack 80, and four developing devices 31C, 31M, 31Y, 31Bk integrally mounted on the developing rack 80. The developing devices 31C, 31M, 31Y and 31Bk respectively accommodate developer containing C, M, Y and Bk toner. The developing rack 80 is rotatable in a clockwise direction on a support shaft 81 as a support point. Each time an electrostatic latent image is formed on the photoreceptor drum 10, each developing device is rotated ¼ of a rotation by a developing device change-over motor (not shown in the figure) so that a developing sleeve 32, of the developing device containing the developer corresponding to the color of the electrostatic latent image formed, is positioned at developing region D.

In the present embodiment, the entire body of the printer is designed to be more compact through the use of a rotary type full-color developing apparatus 30.

A flexible endless intermediate transfer belt 40 is stretched between support rollers 41, 42 and tension rollers 43, 44 and is rotated in a direction as shown by an arrow b synchronized with the photoreceptor drum 10. On the side of the intermediate transfer belt 40 a belt mark (not shown in the figure) is provided to register the leading end of toner image corresponding to each color. Based upon detection of the belt mark by a photosensor 45, image forming operations such as exposure, developing and transfer are controlled. A protrusion may be provided on the side of the intermediate transfer belt 40. Based upon detection of the protrusion with a microswitch, the image forming operations can be controlled. The intermediate transfer belt 40 is pressed by a rotatable primary transfer roller 46 so as to contact with the photoreceptor drum 10. This contact area is primary transfer portion T1.

Furthermore, the intermediate transfer belt 40 faces a horizontal feed path 65 for feeding a recording sheet (described below) at a portion supported by the support roller 42. A rotatable secondary transfer roller 47 is arranged so that it can make contact with and be retracted from the intermediate transfer belt 40. The contact area between this intermediate transfer belt 40 and the secondary transfer roller 47 is secondary transfer portion T2. A secondary transfer roller solenoid (not shown in the figure) is also provided to bring the secondary transfer roller 47 into contact with or retract it from the intermediate transfer belt 40.

Figure 3:
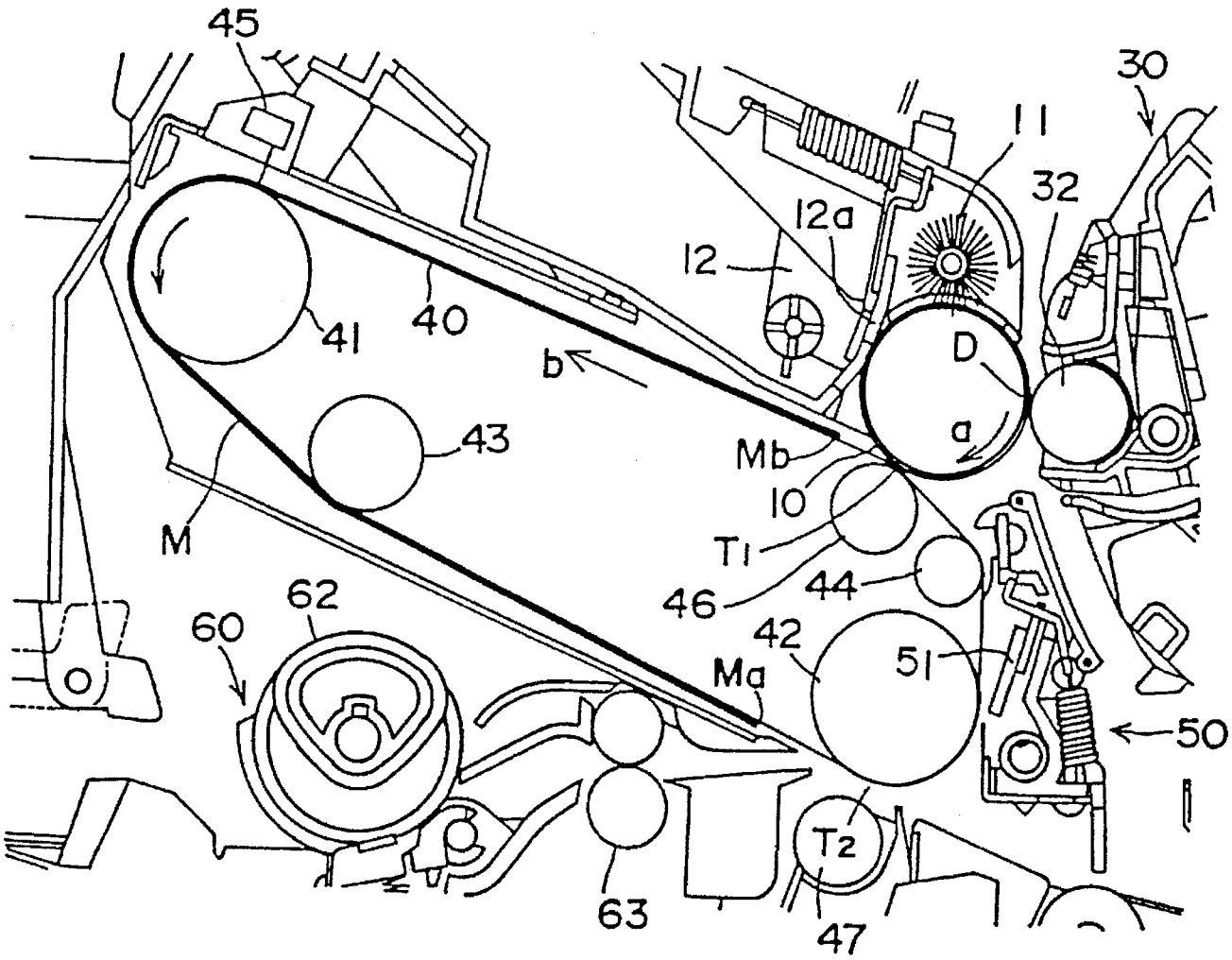
FIG. 3 shows the state in which the secondary transfer roller and the cleaning blade are retracted from the intermediate transfer belt in the printer shown in FIG. 1.
Figure 4:
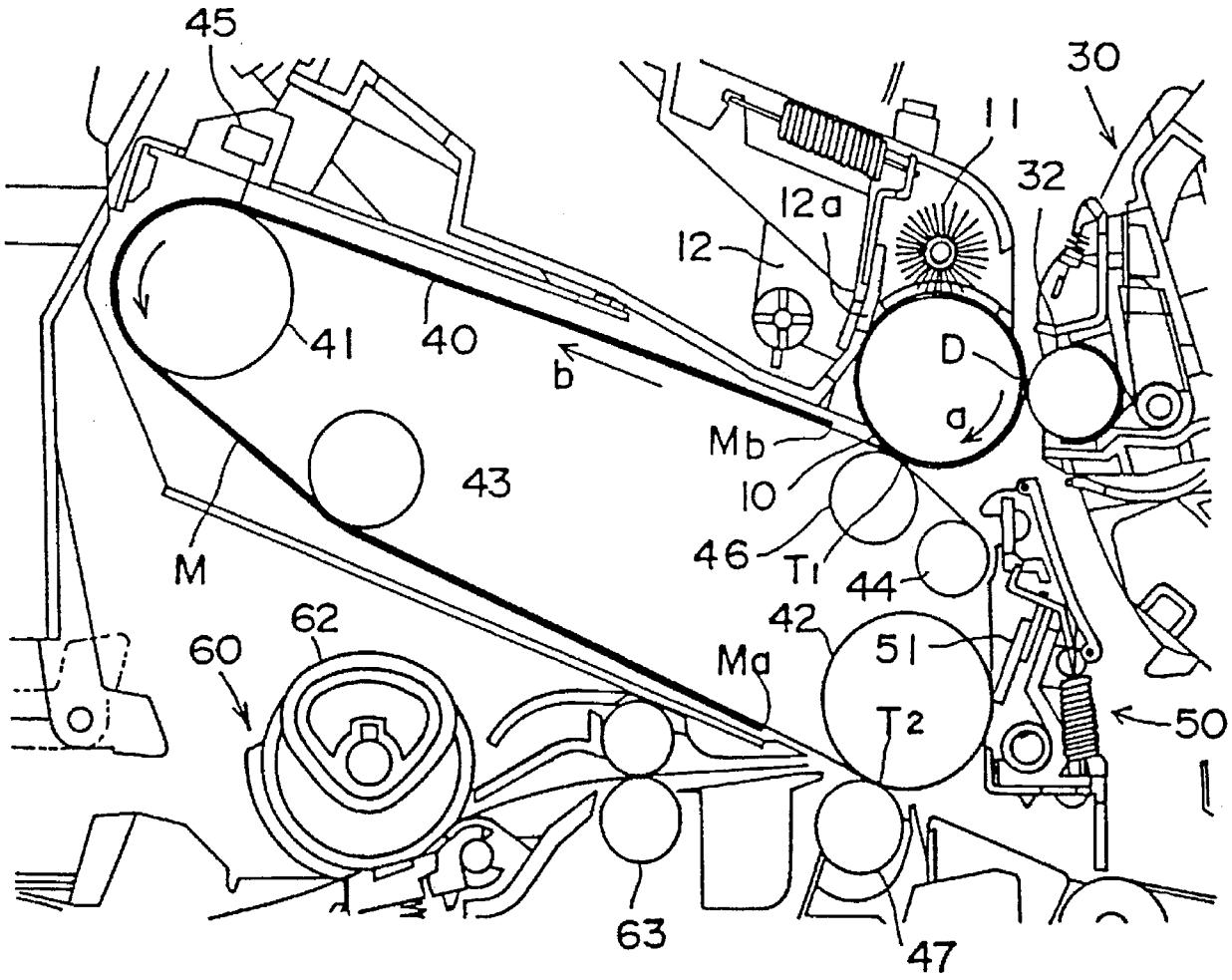
FIG. 4 shows the state in which the secondary transfer roller and the cleaning blade are brought into contact with the intermediate transfer belt in the printer shown in FIG. 1.

A cleaner 50 is further disposed in the space between said developing unit 30 and the intermediate transfer belt 40. The cleaner 50 has a cleaning blade 51 to scrape off toner remaining on the intermediate transfer belt 40. This cleaning blade 51 can be brought into contact with and retracted from the intermediate transfer belt 40 by a cleaner solenoid (not shown in the figure) as shown in FIGS. 3 and 4.

The paper feeder 60 comprises a paper feed tray 61 openable at the front of the printer main body 1 (at which an operator usually stands), a paper feed roller 62 and a timing roller 63. The recording sheets S are loaded on the paper feed tray 61, fed in the right direction in the figure one by one by the rotation of the paper feed roller 62 and then fed to the secondary transfer portion T2 by the timing roller 63 synchronized with the full-color toner image formed on the intermediate transfer belt 40.

The horizontal feed path 65 of recording sheet comprises an air suction belt 66. On the downstream side of a fixing assembly 70 with respect to a feed direction of the recording sheet is provided a vertical feed path 71 comprising feed rollers 72, 73, 74. The recording sheet S passes through this vertical feed path 71 and is delivered to the upper surface of the printer main body 1.

The intermediate transfer belt 40 confronts the developing unit 30 through the photoreceptor drum 10 and is arranged above the horizontal feed path 65 (including the paper feeder 60). Furthermore, the length of the portion from the primary transfer portion T1 to the secondary transfer portion T2 on the intermediate transfer belt 40 is set to be slightly longer than the length of the largest size recording sheet that can be used (A4 size length in vertical direction). On the other hand, the length of the portion from the secondary transfer portion T2 to the primary transfer portion T1 on the intermediate transfer belt 40 is set to the length of the shortest path. As shown in FIG. 3 and FIG. 4, the portion indicated by the thick solid lines is the maximum length of image forming region M.

Referring to the timing chart of FIG. 5, the full-color print operation in the present embodiment will be described hereinbelow.

When the print operation starts, the secondary transfer roller 47 and the cleaning blade 51 separate from the intermediate transfer belt 40 (see FIG. 3). When the print operation is started, the photoreceptor drum 10 is rotated in the direction of arrow a and the intermediate transfer belt 40 is rotated in the direction of arrow b at the same peripheral speed and the photoreceptor drum 10 is then charged to a prescribed electric potential by the charging brush 11.

Subsequently, exposure of a cyan image is carried out by the laser scanning optical system 20 and an electrostatic latent image of a cyan image is formed on the photoreceptor drum 10. This electrostatic latent image is immediately developed by the developing device 31C to form a toner image, and the toner image is transferred onto the intermediate transfer belt 40 at the primary transfer portion T1. Even if the toner image transferred onto the intermediate transfer belt 40 is the maximum size as shown in FIG. 3, before the leading end Ma of the toner image reaches the secondary transfer portion T2, the trailing end Mb of the toner image is transferred on the intermediate transfer belt 40, so that the primary transfer is completed. Immediately after completion of the primary transfer, the developing device 31M is switched to developing region D and thereupon, exposure, developing and primary transfer of a magenta image is carried out. Similarly, the switching of developing device 31Y to the developing region D, exposure, developing and primary transfer of a yellow image is carried out. Further, switching of developing device 31Bk to the developing region D, exposure, developing and primary transfer of a black image is carried out. In this way, cyan, magenta, yellow and black toner images are superimposed on the intermediate transfer belt 40 to form a full-color toner image on the belt 40.

When the primary transfer of the black image is completed, the developing device 31C of the developing unit 30 is switched to the developing portion D for the next print process, and the secondary transfer roller 47 and the cleaning blade 51 are brought into contact with the intermediate transfer belt 40 (see FIG. 4). At this time, the recording sheet S is fed into the secondary transfer portion T2 and the full-color toner image formed on the intermediate transfer belt 40 is transferred onto the recording sheet. When this secondary transfer completes, the secondary transfer roller 47 and the cleaning blade 51 are retracted from the intermediate transfer belt 40.

Figure 6:
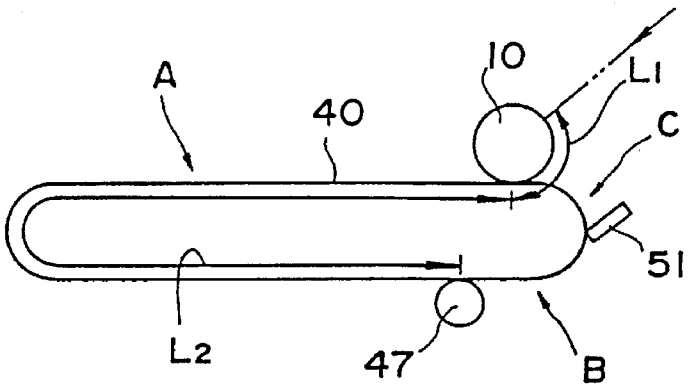
FIG. 6 is a model view of the periphery of the intermediate transfer belt inside the printer shown in FIG. 1.

FIG. 6 is a model view of the periphery of the intermediate transfer belt inside the printer shown in FIG. 2.

As shown in FIG. 6, in this embodiment in particular, when the intermediate transfer belt 40 is divided into a first region A extending from the primary transfer portion T1 to the secondary transfer portion T2, a second region B extending from the secondary transfer portion T2 to the contact portion with the cleaning blade 51 of the cleaner 50 and a third region C extending from the contact portion with the cleaning blade 51 to the primary transfer portion T1, the length of the first region A is set to the length of the largest sized recording sheet that can be used. Then, only in a state when a toner image is formed inside the first region A, the secondary transfer roller 47 and the cleaning blade 51 are allowed to be contacted with or retracted from the intermediate transfer belt 40.

With respect to the rotational direction a of the photoreceptor drum 10, the length from the exposure position by the laser beam on the photoreceptor drum 10 to the primary transfer portion T1 is set at L1 (mm) and the length along the periphery of the first region A is set at L2 (mm). During (L2–L0)/V (sec.) after passage of (L0+L1)/V (sec.) from the start of exposure, the contact/retraction operation to/from the intermediate transfer belt 40 of the secondary transfer roller 47 and the cleaning blade 51 as well as the developer change-over operation are allowed. Here, L0 represents the length L0 (mm) of the recording sheet S and V represents the system speed V (mm/sec.). This system speed V is equivalent to the feed speed of the intermediate transfer belt 40. Further, when the print speed of the printer is n (print/min.), the number of colors superimposed is k and the peripheral length of the intermediate transfer belt 40 is L (mm), then V=nkL/60.

Figure 5:
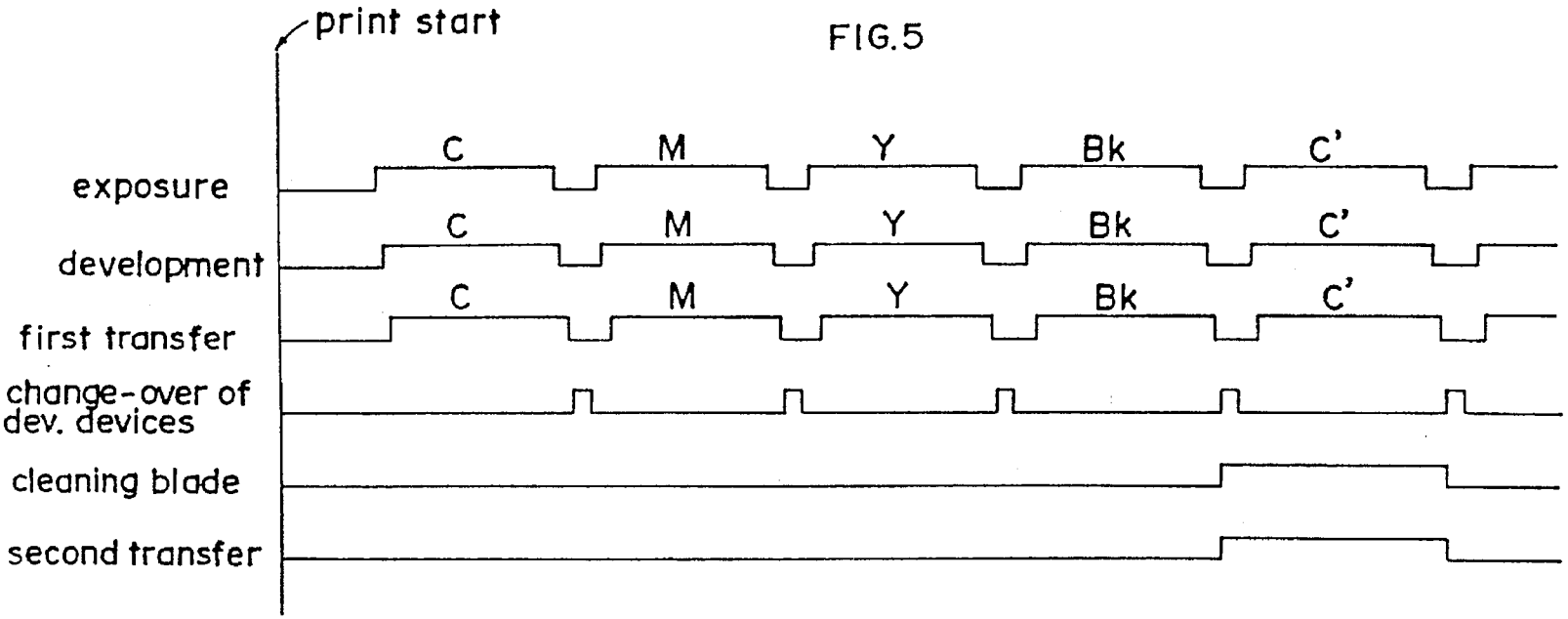
FIG. 5 is a timing chart showing the print operation of the printer shown in FIG. 1.

During the secondary transfer, based on the cyan image data a cyan image is formed on the photoreceptor for the next print and then the primary transfer is carried out onto the intermediate transfer belt 40 (see C' of FIG. 5). Using the above control, the secondary transfer roller 47 and the cleaning blade 51 are brought into contact with the intermediate transfer belt 40 before the primary transfer of the cyan image for the next print is started. After the primary transfer of the cyan image for the next print is completed, the secondary transfer roller 47 and the cleaning blade 51 are retracted from the intermediate transfer belt 40.

Therefore, damage to the image formed on the belt 40 due to vibrations of the intermediate transfer belt 40 occurred when the secondary transfer roller 47 and the cleaning blade 51 are brought into contact with the intermediate transfer belt 40 or are retracted from the intermediate transfer belt 40 is prevented.

Further, in the present embodiment, image forming region M (in the portion extending from the primary transfer portion T1 to the secondary transfer portion T2) of the intermediate transfer belt 40 extends in the direction retracted from the developing unit 30 while the portion extending from the secondary transfer portion T2 to the primary transfer portion T1 is substantially corresponding to the shortest path. Therefore, the cleaner 50 can be disposed in the space above the horizontal feed path 65 and between the developing unit 30 and the intermediate transfer belt 40, enabling the empty space inside the printer to be effectively utilized. Moreover, because the cleaner 50 is disposed just behind the secondary transfer portion T2, the cleaning blade 51 is brought into contact with the intermediate transfer belt 40 before the start of the primary transfer of the cyan image for the next print, and is retracted from the intermediate transfer belt 40 after the completion of the primary transfer of the cyan image for the next print. Any image distortion does not occur by the contact/retraction operation of the cleaning blade 51.

In the present embodiment, when the secondary transfer roller 47 and the cleaning blade 51 are brought into contact with the intermediate transfer belt 40, the cleaning blade 51 and the secondary transfer roller 47 are brought into contact in this order. Conversely, when the secondary transfer roller 47 and the cleaning blade 51 are retracted from the intermediate transfer belt 40, the secondary transfer roller 47 and the cleaning blade 51 are retracted in this order. Therefore, strong vibration occurring on the transfer belt caused by both the secondary transfer roller and the cleaning blade 51 simultaneously being brought into contact with or retracted from the belt 40 are avoided. Furthermore, in the short time the secondary transfer roller 47 and the cleaner 50 are brought into contact with and retracted from the transfer belt 40, the cleaning time is reliably set to be long and the contact time of the secondary transfer roller 47 is reliably set to be short.

The secondary transfer to the recording sheet S is performed by applying a voltage to the secondary transfer roller 47. In the present embodiment, however, after the secondary transfer roller 47 is brought into contact with the intermediate transfer belt 40, a voltage is applied to the secondary transfer roller 47. Then, after the application of this voltage to the secondary transfer roller 47 stops, the secondary transfer roller 47 is retracted from the intermediate transfer belt 40. Therefore, with the voltage in an OFF state, the secondary transfer roller 47 must be brought into contact with the intermediate transfer belt 40 or retracted from the belt 40, thus generation of electrical discharges and noise can be prevented.

Figure 7:
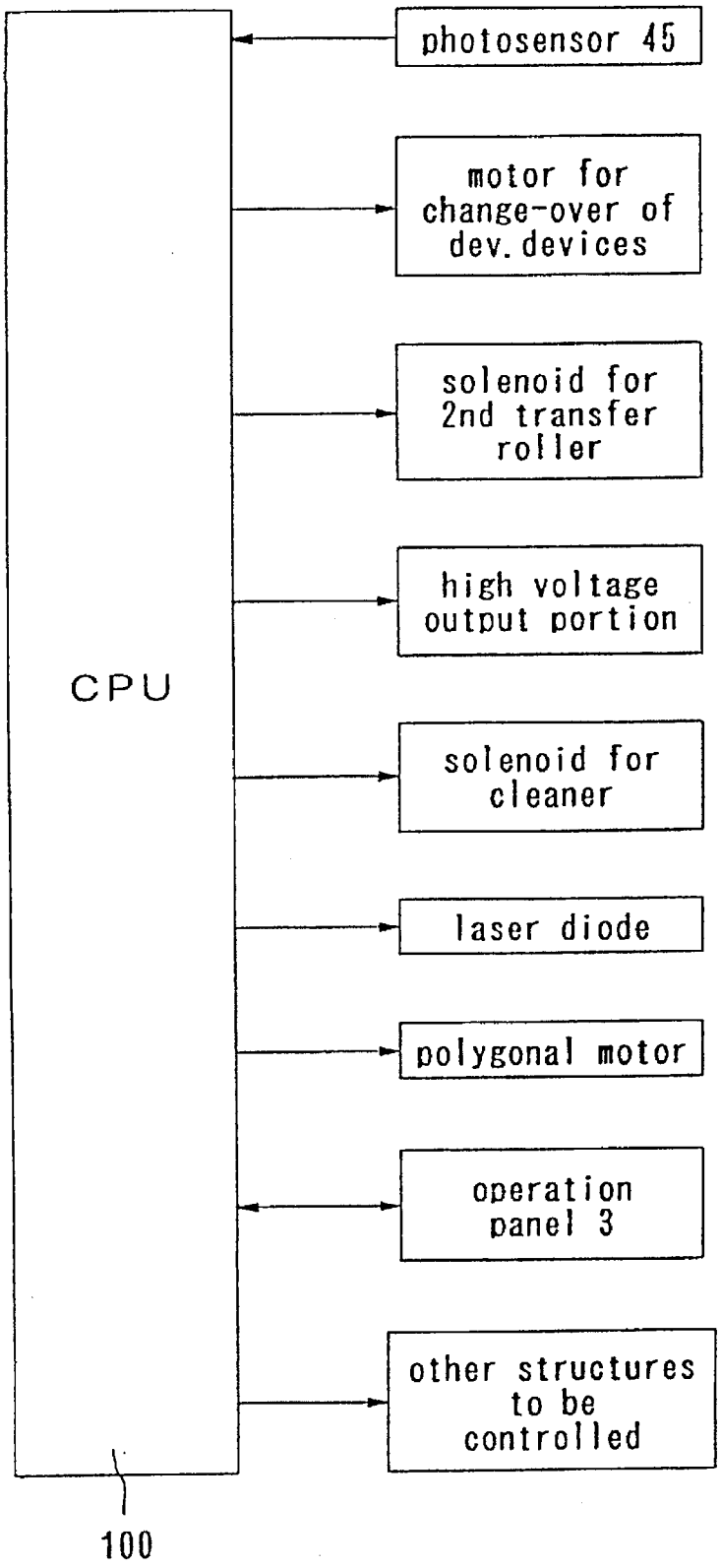
FIG. 7 is an outline block diagram of the printer shown in FIG. 1.

FIG. 7 is an outline block diagram of the printer shown in FIG. 1.

In the printer 1 of this embodiment, the CPU 100 is provided as a control means. Said photosensor 45, a developing device change-over motor, a secondary transfer roller solenoid and a cleaner solenoid are connected to the CPU 100. Furthermore, connected to the CPU 100 are a high-voltage output portion that is housed inside the secondary transfer roller 47 and applies a voltage to the secondary transfer roller 47, a laser diode used as a light source that turns ON/OFF laser illumination, a polygon motor that controls the rotation of a polygon mirror onto which light from the laser diode is illuminated, an operation panel 3 on which each operation is inputted by the operator and each type of display is displayed (see FIG. 1) as well as other mechanisms.

In response to the reception of print signals from the operation panel 3 and based upon detection results of the belt position of the intermediate transfer belt 40 by the photosensor 45, the CPU 100 computes the timing of the primary transfer and the secondary transfer. Furthermore, the CPU 100 controls the operation of each mechanism inside the printer 1 as well as collectively controlling the sequence of the printing operation including charging, exposure, developing, primary transfer and secondary transfer.

Moreover, by means of the CPU 100 and photosensor 45, timing for start of the primary transfer, start of secondary transfer or start of the change-over of the developing devices is detected.

Next, referring to the flowcharts shown in FIG. 8 to FIG. 11, the operation of the printer of this embodiment will be described.

Figure 8:
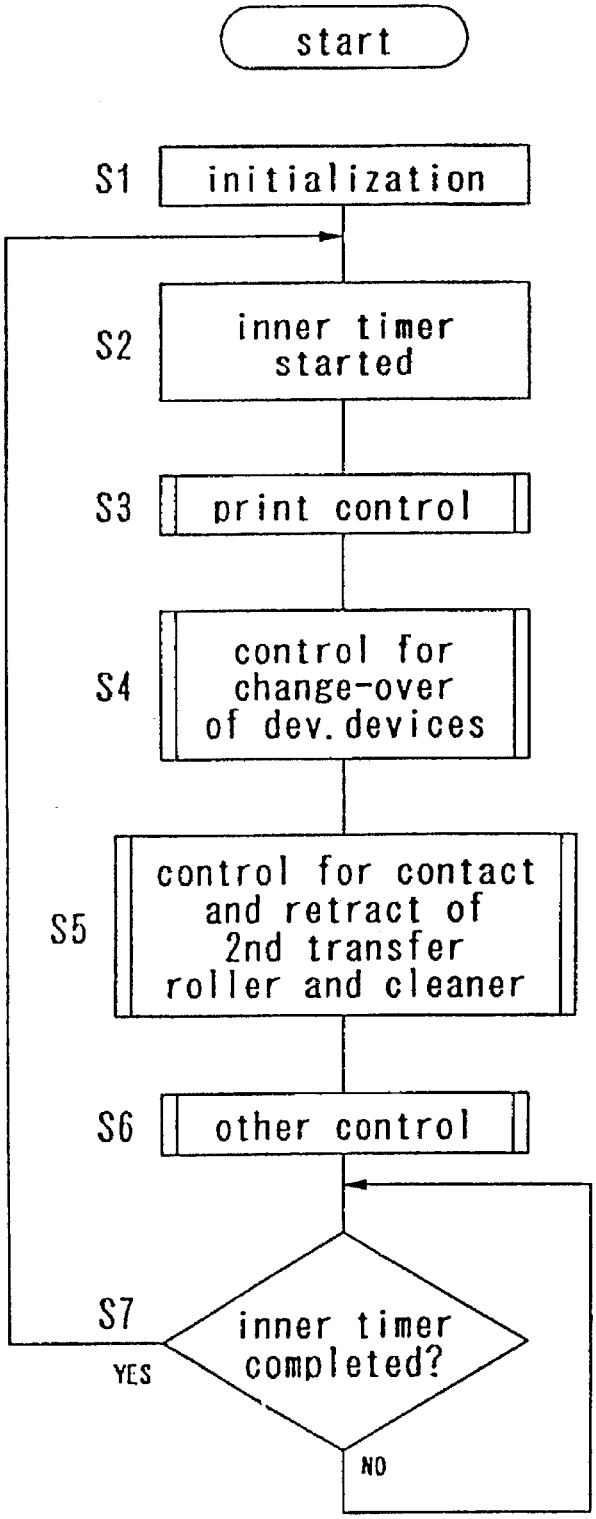
FIG. 8 shows the main control flow performed in the printer shown in FIG. 1.
Figure 9A:
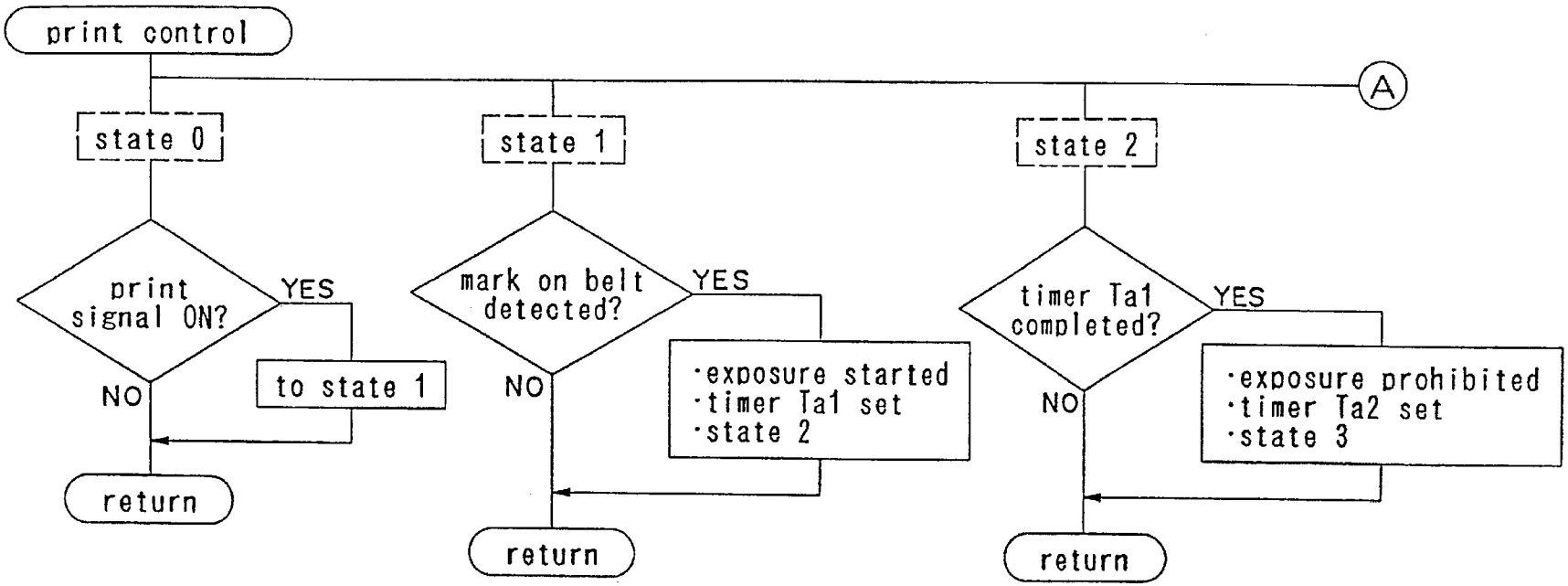
FIGS. 9*a* and 9*b* collectively show a subroutine of the print control shown in FIG. 8.
Figure 9B:
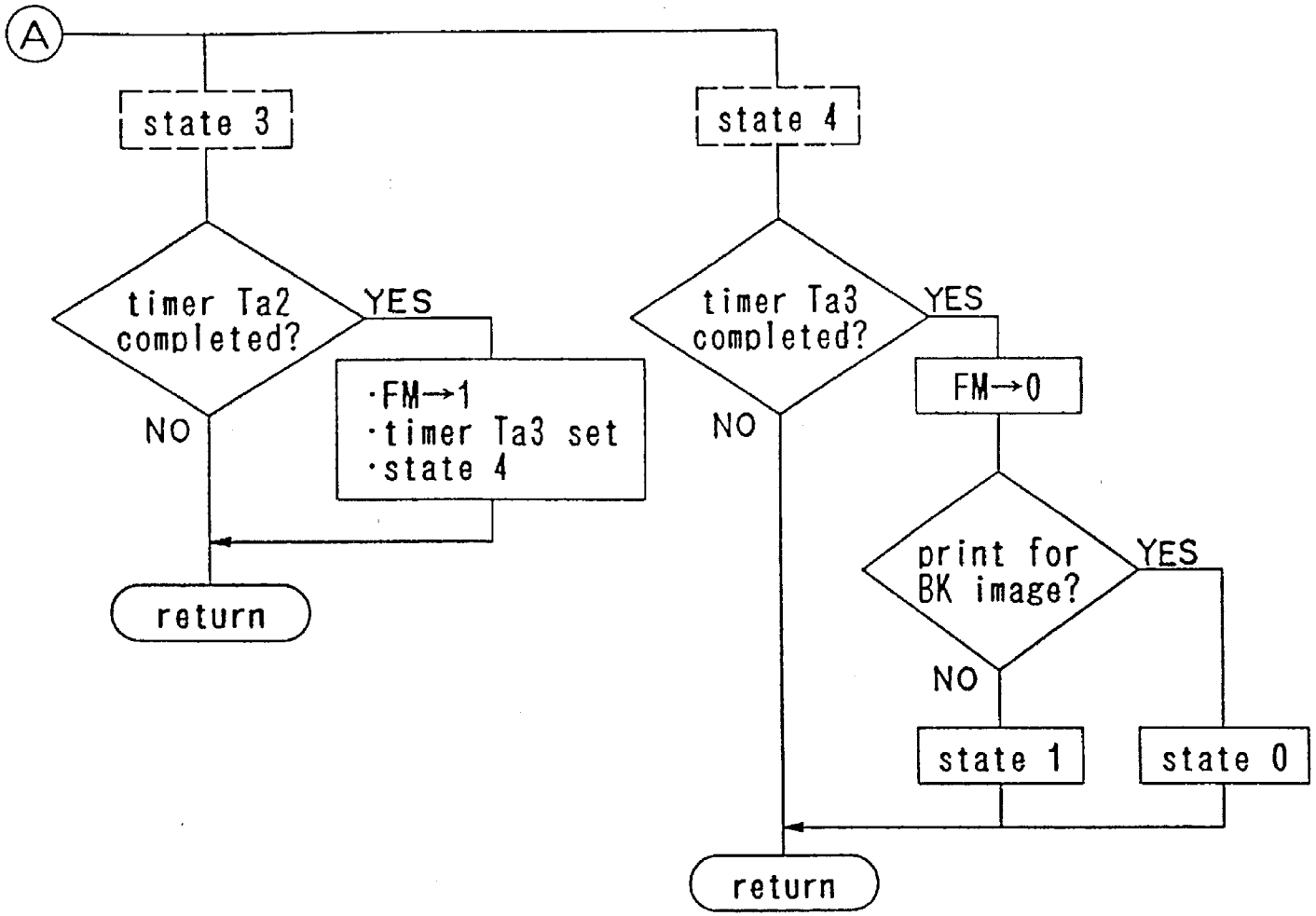
Figure 10:
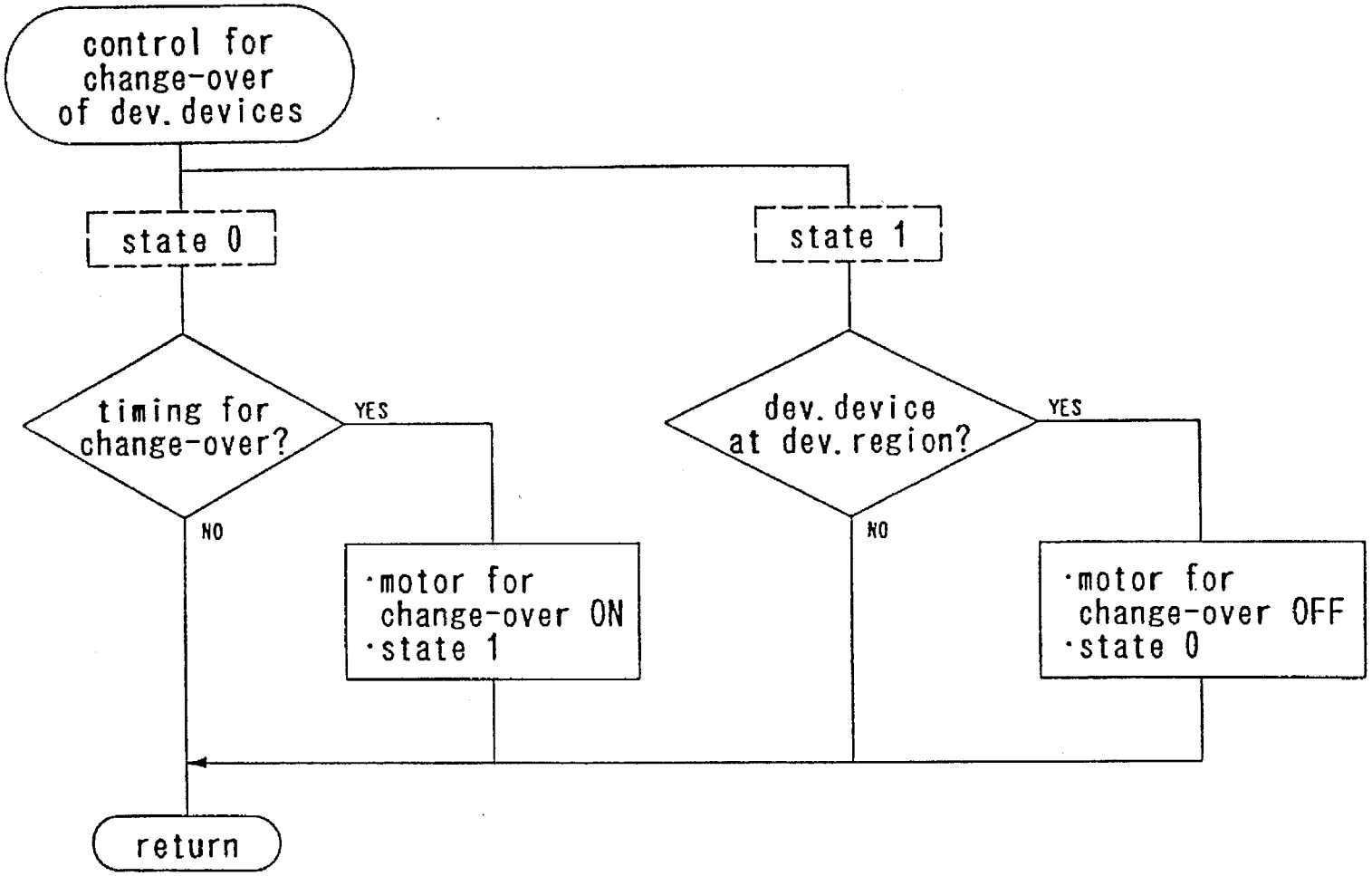
FIG. 10 is a subroutine of the change-over control of the developing devices shown in FIG. 8.
Figure 11A:
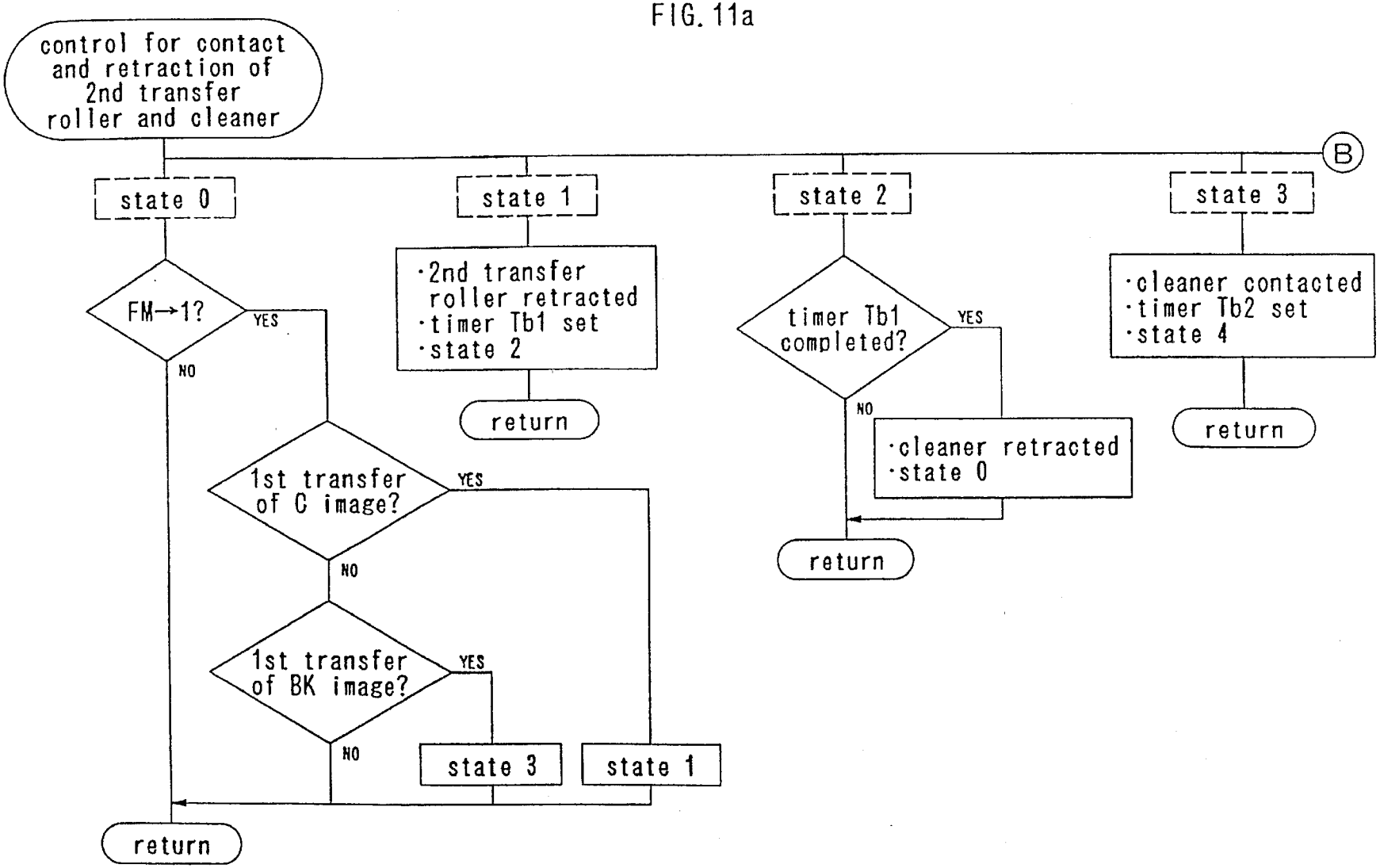
FIGS. 11*a* and 11*b* collectively show a subroutine of contact/retraction control of the secondary transfer roller and cleaner shown in FIG. 8.
Figure 11B:
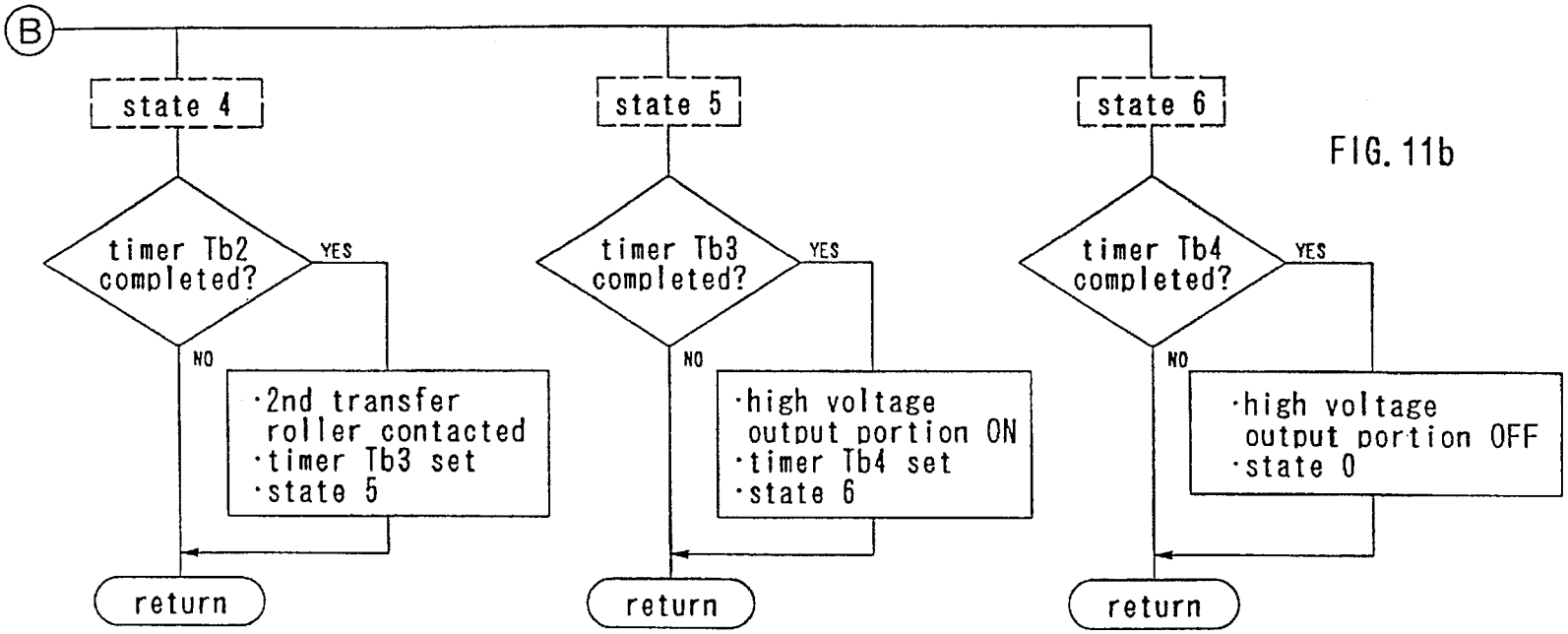

FIG. 8 is the main control flow of the printer shown in FIG. 1. FIGS. 9*a* and 9*b* collectively are a subroutine of the print control as shown in FIG. 8. FIG. 10 is a subroutine of the change-over control of the developing device as shown in FIG. 8. FIGS. 11*a* and 11*b* collectively are a subroutine of contact/retraction control of the secondary transfer roller and the cleaning blade as shown in FIG. 8.

As shown in FIG. 8, when the power supply of the printer 1 is turned ON, initialization of the CPU 100 is carried out (step S1) and the inner timer inside the CPU 100 starts (step S2). Next, the CPU 100 carries out print control which performs the primary transfer of the toner image to the intermediate transfer belt 40 (step S3), change-over control of the developing device which controls the change-over of the developing device accommodating a desirable color of developer (step S4), contact/retraction control of the secondary transfer roller 47 and the cleaner 50 which respectively perform secondary transfer of the toner image to the recording sheet S and removal of toner remaining on the intermediate transfer belt 40 (step S5), and other controls including control for the paper feed of the recording sheet S. Moreover, in step S7 the count by said inner timer is completed.

As shown in FIG. 9, in the print control (step S3 of FIG. 8), when the flow proceeds to state 0 and the CPU 100 detects an ON condition of the print signal, the flow proceeds to state 1. Thereupon, when the belt mark on the intermediate transfer belt 40 is detected by the photosensor 45, exposure is started on the photoreceptor drum 10 by the laser scanning optical system 20 and then the timer Ta1 (which counts the time required for feeding of the transfer belt 40 for the length corresponding to the recording sheet S; L0/V) is set and the flow proceeds to state 2. Next, in state 2, the CPU 100 prohibits exposure at the moment the count by timer Ta1 is completed and then timer Ta2 (which counts the time required for feeding of the transfer belt for the length corresponding to L1 as shown in FIG. 6; L1/V) is set and the flow proceeds to state 3. Further, at a predetermined timing following the exposure, an electrostatic latent image of the first printing color formed on the photoreceptor drum 10 by exposure is developed by the developing unit 30 to form the toner image, and then primary transfer of the toner image is carried out onto the intermediate transfer belt 40 at the primary transfer portion T1.

In the present embodiment in particular, the CPU 100 sets the secondary transfer roller and cleaner contact/retraction enable flag FM to 1 when the count by the timer Ta2 is completed and simultaneously the timer Ta3 (which counts the time required for feeding of the transfer belt 40 for the length corresponding to the length obtained by subtracting the length of recording sheets from the length of the first region A as shown in FIG. 6; (L2–L0)/V) is set and the flow proceeds to state 4. Next, in state 4, the CPU 100 sets the secondary transfer roller and cleaner contact/retraction enable flag FM to 0 when the count by the timer Ta3 is completed. Thereby, only when a toner image is in the first region A whose length is longer than the maximum length of the toner image transferred on the intermediate transfer member (see FIG. 6), the secondary transfer roller 47 and the cleaning blade 51 are permitted to be brought into contact with or retracted from the intermediate transfer belt 40 thus allowing mechanical vibrations to be easily prevented which are accompanied by the contact/retraction operation of the roller 47 and the blade 51 which are the cause of noise in the image.

In state 4, when the secondary transfer roller and cleaner contact/retraction enable flag FM is reset to 0, a judgment is made on whether a black image is printed. If a black image is not printed, the flow returns to state 1 and the toner images are superimposed on the intermediate transfer belt 40 in order.

In the change-over control of the developing devices (step S4 of FIG. 8), as shown in FIG. 10, the flow proceeds to state 0 and if the timing for change-over of the developing devices is detected by the CPU 100 that is controlling the timing for change-over by means of detecting the belt mark on the intermediate transfer belt 40 by the photosensor 45, the motor for change-over of developing devices turns ON and the developing rack 80 is rotated ¼ of a rotation with the support shaft 81 as a support point.

Next, in state 1, when the developing sleeve 32 of the developing device accommodating the desirable color developer is detected to have reached developing region D, the developing device change-over motor is turned OFF. In the present embodiment, the change-over operation handled by the developing device change-over motor is carried out when said secondary transfer roller 47 and the cleaning blade 51 can be brought into contact with or retracted from the intermediate transfer belt 40. Therefore, the vibration occurring along with the developing device change-over operation are specifically permitted only when a toner image is in the first region A (see FIG. 6) whose length is longer than the maximum length of the toner image transferred on the intermediate transfer member, thus allowing the prevention of image noise occurring along with this change-over operation.

As shown in FIG. 11, in contact/retraction control of the secondary transfer roller 47 and the cleaner 50 (step S5 of FIG. 8), the flow proceeds to state 0. When the CPU 100 detects that the secondary transfer roller and cleaner contact/retraction enable flag is set at 1 and the toner image for primary transfer is a cyan image, the flow proceeds to state 1. In state 1, the secondary transfer roller 47 is retracted from the intermediate transfer belt 40 along with the timer Tb1 setting and the flow proceeding to state 2. In state 2, the cleaning blade 51 of the cleaner 50 is retracted from the intermediate transfer belt 40 when the count by the timer Tb1 is completed. In short, after a fixed time counted by the timer Tb1 elapses from the time the secondary transfer roller 47 was retracted from the intermediate transfer belt, the cleaning blade 51 is retracted. When (L2–L0)/V=T, time counted by the timer Tb1 is set to be not longer than T. Further, when the toner image for primary transfer is a magenta or yellow image, the secondary transfer roller 47 and the cleaning blade 51 are maintained in a state retracted from the intermediate transfer belt 40.

On the other hand, when the CPU detects that the secondary transfer roller and cleaner contact/retraction enable flag FM is set at 1 and the toner image for primary transfer is a black image, the flow proceeds to state 3. In state 3, the CPU 100 brings the cleaning blade 51 of the cleaner 50 into contact with the intermediate transfer belt 40 along with setting the timer Tb2 and the flow proceeding to state 4. In state 4, the secondary transfer roller 47 is brought into contact with the intermediate transfer belt 40 when the count by the timer Tb2 is completed.

In short, after a fixed time counted by the timer Tb2 elapses from the time the cleaning blade 51 made contact with the intermediate transfer belt 40, the secondary transfer roller 47 is brought into contact with the intermediate transfer belt 40.

Because the cleaning blade 51 and the secondary transfer roller 47 are brought into contact with the intermediate transfer belt 40 in this order and are retracted from the belt 40 in the opposite order, strong vibrations occurring on the intermediate transfer belt 40 caused by both the secondary transfer roller 47 and the cleaner 50 simultaneously being brought into contact with or retracted from the belt 40 can be prevented. Furthermore, in the short time the secondary transfer roller 47 and the cleaner 50 can be brought into contact with and retracted from the transfer belt 40, the cleaning time can be reliably set to be long and the contact time of the secondary transfer roller 47 can be reliably set to be short enabling both the toner remaining on the intermediate transfer belt 40 to be wiped off and contamination of the secondary transfer roller 47 to be prevented.

Then, in state 5, when the count by the timer Tb3 is completed, the high-voltage output portion turns ON, the timer Tb4 is set and the flow proceeds to state 6. In state 6, the high-voltage output portion applies a voltage for the secondary transfer for a fixed time counted by the timer Tb4, and a full-color image is then transferred to the recording sheet S. When the count by the timer Tb4 is completed, the high-voltage output portion turns OFF and the flow returns to state 0. This is how the contact and retraction of the secondary transfer roller 47 to and from the intermediate transfer belt 40 is done with the voltage in an OFF state, thus ensuring there will be no occurrence of electromagnetic noise due to discharges allowing the spread of adverse effects to electronic components inside and outside the equipment to be prevented. When (L2–L0) / V=T, the total time counted by the timers Tb2 and Tb3 is set to be not longer than T. Time counted by the timer Tb4 is set to be almost equal to L0/V.

Figure 12:
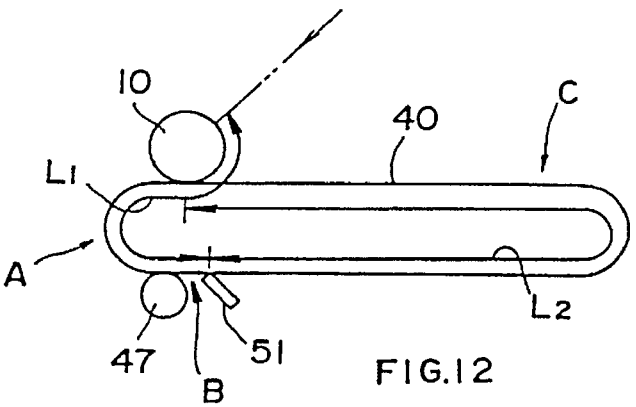
FIG. 12 is a model view of the periphery of the intermediate transfer belt inside the full-color laser printer as the second embodiment of the present invention.

FIG. 12 is a model view of the periphery of the intermediate transfer belt of a printer which is the second embodiment according to the present invention. Portions common to the printer shown in FIG. 6 use identical numbers and their description is partly omitted.

In the printer as shown in FIG. 12, the length L2 of the third region C, extending from the contact portion of the cleaning blade 51 of the intermediate transfer belt 40 to the primary transfer portion T1, is set to be longer than the length of the largest size recording sheet that can be used.

This way of constructing the apparatus also permits controlling the contact and retraction of the secondary transfer roller 47 and the cleaning blade 51 to or from the intermediate transfer belt 40 only when a toner image is formed in a region having length L2, thus achieving the same effect as the above-mentioned first embodiment. It is to be noted here that the period from completion of the primary transfer of the black toner image for the first print to the start of exposure based upon printing data of cyan for the second print in the second embodiment is longer than that period in the first embodiment.

Furthermore, the embodiments described above are described in order to make it easier to understand the present invention and not to place limitations on the invention. Therefore, each element disclosed in said embodiment includes all design modifications or equivalent means appended to the claims of this invention. For example, although in the above-mentioned embodiment, the description uses a photoreceptor drum as a photoreceptor on which is formed electrostatic latent images, the present invention is not limited to this and can also be applied to a printer which uses a belt-shaped photoreceptor.

Moreover, the present invention can also be applied to a full-color copying machine provided with a means to read document images instead of printing out images using printing data from an external device.

Even further, the mechanism to bring into contact and retract to/from the secondary transfer roller 47 and the cleaning blade 51 is freely selected.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus wherein a toner image, formed by developing an electrostatic latent image on a photoreceptor, is primarily transferred to an intermediate transfer member in a primary transfer and is secondarily transferred to a recording sheet in a secondary transfer, said image forming apparatus comprising:

a retractable transfer member which secondarily transfers the toner image onto the recording sheet;

a retractable cleaning member which removes a residual toner on the intermediate transfer member after a secondary transfer;

a first detector which detects whether a primary transfer is being performed;

a second detector which detects whether a secondary transfer is being performed; and a controller which allows the retractable transfer member and the cleaning member to contact with or retract from the intermediate transfer member when the primary transfer and the secondary transfer are not being performed.

2. An image forming apparatus as claimed in claim 1 wherein a surface of the photoreceptor is charged and exposed to form the electrostatic latent image, wherein said first detector includes a timer for counting a time T1 from a start of exposure to a completion of a primary transfer, wherein said second detector includes a timer for counting a time T2 from a completion of a primary transfer to a start of a secondary transfer, and wherein said controller allows the retractable transfer member and the cleaning member to contact with or retract from the intermediate transfer member during the time T2.

3. An image forming apparatus as claimed in claim 2 wherein the time T1 and the time T2 respectively satisfy the following relationships:

$$T1=(L0+L1)/V \text{ (sec.)}$$

$$T2=(L2-L0)/V \text{ (sec.)}$$

wherein:

L0: is length of the recording sheet (mm),

L1: is length from exposure position on the photoreceptor to a primary transfer portion where the intermediate transfer member contacts the photoreceptor (mm), L2: is length from the primary transfer portion to a secondary transfer portion where the intermediate transfer member contacts the recording sheet (mm), and V: is system speed (mm/sec.).

4. An image forming apparatus as claimed in claim 3 wherein L2 is longer than a maximum length of a toner image transferred onto the intermediate transfer member.

5. An image forming apparatus as claimed in claim 1 wherein said controller controls the cleaning member and the retractable transfer member so that the cleaning member makes contact with the intermediate transfer member before the retractable transfer member makes contact with the intermediate transfer member, and so that the retractable transfer member retracts from the intermediate transfer member before the cleaning member retracts from the intermediate transfer member.

6. An image forming apparatus as claimed in claim 1 wherein a voltage is applied to the retractable transfer member when a secondary transfer is performed, wherein the controller starts an application of the voltage to the retractable transfer member after contacting the retractable transfer member with the intermediate transfer member, and wherein the controller retracts the retractable transfer member from the intermediate transfer member after stopping the application of the voltage to the retractable transfer member.

7. An image forming apparatus as claimed in claim 1 further comprising:

developing means having a plurality of developing devices, each of said developing devices accommodating a different color developer; and a change-over means for positioning a developing device accommodating a desired one of the color developers so as to be opposite to the photoreceptor, and wherein said change-over means is operated when the retractable transfer member and the cleaning member are allowed to contact with or retract from the intermediate transfer member.

8. An image forming apparatus wherein a toner image, formed on a photoreceptor, is primarily transferred to an intermediate transfer member at a primary transfer portion during a primary transfer and is secondarily transferred to a recording sheet at a secondary transfer portion during a secondary transfer, said image forming apparatus comprising:

a retractable transfer member provided so as to contact with or retract from the intermediate transfer member at the secondary transfer portion for secondarily transferring a toner image onto the recording sheet;

a cleaning member provided so as to contact with or retract from the intermediate transfer member, for removing a residual toner on the intermediate transfer member;

wherein in the intermediate transfer member, at least one of a first region, extending from the primary transfer portion to the secondary transfer portion, or a second region, extending from the cleaning member to the primary transfer member, has a length which is longer than a length of one toner image primarily transferred onto the intermediate transfer member; and a controller for allowing the retractable transfer member and the cleaning member to contact with or retract from the intermediate transfer member when both of a leading end of the toner image and a trailing end of the toner image are in either of the first region or the second region in the intermediate transfer member.

9. An image forming apparatus as claimed in claim 8 wherein said controller controls the cleaning member and the retractable transfer member so that the cleaning member makes contact with the intermediate transfer member before the retractable member makes contact with the intermediate transfer member, and so that the retractable transfer member retracts from the intermediate transfer member before the cleaning member retracts from the intermediate transfer member.

10. An image forming apparatus as claimed in claim 8 wherein a voltage is applied to the retractable transfer member when a secondary transfer is performed, the controller starts an application of the voltage to the retractable transfer member after contacting the retractable transfer member with the intermediate transfer member, and the controller retracts the retractable transfer member from the intermediate transfer member after stopping the application of the voltage to the retractable transfer member.

11. An image forming apparatus as claimed in claim 8 further comprising:

developing means having a plurality of developing devices each of said developing devices accommodating a different color developer; and a change-over means for positioning a developing device accommodating a desired one of the color developers so as to be opposite to the photoreceptor, and wherein said change-over means is operated when the retractable transfer member and the cleaning member are allowed to contact with or retract from the intermediate transfer member.

12. An image forming method wherein a toner image, formed on a photoreceptor, is primarily transferred to an intermediate transfer member in a primary transfer and is secondarily transferred to a recording sheet in a secondary transfer, said method comprising the steps of:

providing a retractable transfer member so as to contact with or retract from the intermediate transfer member for secondarily transferring a toner image onto the recording sheet;

providing a cleaning member so as to contact with or retract from the intermediate transfer member for removing a residual toner on the intermediate transfer member;

detecting whether a primary transfer is being performed;

detecting whether a secondary transfer is being performed; and allowing the retractable transfer member and the cleaning member to contact with or retract from the intermediate transfer member when neither a primary transfer nor a secondary transfer is being performed.

13. A full-color image forming apparatus comprising:

a rotatable photoreceptor on a surface of which an electrostatic latent image can be formed;

a plurality of developing devices positioned opposite to the photoreceptor, each of the developing devices accommodating a different color developer;

a rotatable intermediate transfer member positioned opposite to the developing devices through the photoreceptor, said intermediate transfer member contacting with the photoreceptor at a primary transfer portion and contacting with a recording sheet at a secondary transfer portion;

the intermediate transfer member having a first region, extending from the primary transfer portion to the secondary transfer portion and having at least a length corresponding to a length of a largest size of recording sheet usable in said apparatus, and a second region, extending from the secondary transfer portion to the primary transfer portion and having a length corresponding to a shortest path; and a cleaning member disposed in said second region for removing a residual toner on the intermediate transfer member.

14. A full-color image forming apparatus as claimed in claim 13 wherein said intermediate transfer member is a flexible endless belt.

15. A full-color image forming apparatus as claimed in claim 13 wherein said cleaning member includes a blade.

16. A full-color image forming apparatus as claimed in claim 13 wherein said developing devices are integrally mounted on a rotatable developing rack.

17. A full-color image forming apparatus as claimed in claim 13 wherein a retractable transfer member is provided so as to contact with or retract from the intermediate transfer member at the secondary transfer portion for transferring a toner image on the intermediate transfer member to a recording sheet.

18. A full-color image forming apparatus as claimed in claim 13 wherein a transport path for transporting a recording sheet having a toner image thereon is provided substantially horizontally below the developing devices.

* * * * *